US005317344A

United States Patent [19]

Beaman et al.

[11] Patent Number: 5,317,344

[45] Date of Patent: May 31, 1994

[54] LIGHT EMITTING DIODE PRINTHEAD HAVING IMPROVED SIGNAL DISTRIBUTION APPARATUS

[75] Inventors: Bryan A. Beaman, Churchville; Jeffrey G. LaPointe, Spencerport; David A. Newman, Rochester, all of N.Y.

[73] Assignee: Eastman Kodak Company, Rochester, N.Y.

[21] Appl. No.: 455,125

[22] Filed: Dec. 22, 1989

[51] Int. Cl.[5] ..... B41J 2/45

[52] U.S. Cl. ..... 346/107 R; 346/139 R

[58] Field of Search ..... 346/107 R, 108, 155, 346/139 R, 150; 174/68.2; 257/778; 361/393, 395, 397, 412

[56] References Cited

U.S. PATENT DOCUMENTS

| | | | |
|---|---|---|---|
| 3,439,309 | 4/1969 | Giger et al. | 174/68.2 |
| 4,273,952 | 6/1981 | Weiss | 174/68.2 |
| 4,318,597 | 3/1982 | Kotani et al. | 334/5 |
| 4,454,167 | 6/1984 | Bernot et al. | 427/96 |
| 4,455,578 | 6/1984 | Fearnside | 358/302 |
| 4,522,667 | 6/1985 | Hanson et al. | 174/68.5 |
| 4,524,372 | 6/1985 | De Cock et al. | 346/160 |
| 4,536,778 | 8/1985 | De Schamphelaere et al. | 346/160 |
| 4,566,170 | 1/1986 | Dolan | 29/569 |
| 4,571,602 | 2/1986 | De Schamphelaere et al. | 346/108 |
| 4,587,717 | 5/1986 | Daniele et al. | 29/569 |
| 4,605,944 | 8/1986 | Ishii et al. | 357/17 |
| 4,635,073 | 1/1987 | Hanson | 346/140 R |
| 4,689,694 | 8/1987 | Yoshida | 358/298 |
| 4,724,283 | 2/1988 | Shimada et al. | 174/68.5 |
| 4,734,714 | 3/1988 | Takasu et al. | 346/107 |
| 4,746,941 | 5/1988 | Pham et al. | 364/519 |
| 4,779,108 | 10/1988 | Inoue | 346/160 |
| 4,820,013 | 4/1989 | Fuse | 357/30 X |
| 4,821,051 | 4/1989 | Hediger | 346/155 |
| 4,831,395 | 5/1989 | Pham et al. | 346/160 |
| 4,835,549 | 5/1989 | Samejima et al. | 346/76 |
| 4,851,862 | 7/1989 | Newman et al. | 346/107 R |
| 4,896,168 | 1/1990 | Newman et al. | 346/107 R |
| 4,929,965 | 5/1990 | Fuse | 346/107 R |
| 4,942,405 | 7/1990 | Dody et al. | 346/107 R |
| 4,973,988 | 11/1990 | Stephenson | 346/76 PH |

FOREIGN PATENT DOCUMENTS

| | | | |
|---|---|---|---|
| 0237663 | 10/1986 | Japan | 346/76 PH |
| 8908894 | 9/1989 | PCT Int'l Appl. . | |
| 8908927 | 9/1989 | PCT Int'l Appl. . | |
| 2099221 | 12/1982 | United Kingdom . | |

OTHER PUBLICATIONS

Rudolf F. Graf, *Radio Shack Dictionary of Electronics*, Howard W. Sams and Co., Inc., Indianapolis, IN., fourth edition, second proofing-1974, p. 76.

*Primary Examiner*—Benjamin R. Fuller
*Assistant Examiner*—David Yockey
*Attorney, Agent, or Firm*—Norman Rushefsky

[57] ABSTRACT

A printhead, particularly a light emitting diode (LED) printhead, which has improved apparatus for distributing signals to individual printing elements, i.e. LEDs, that are used in the printhead. Specifically, this printhead contains a number of print element arrays, typically arrays of light emitting diodes, and a corresponding number of drive circuits all of which are mounted to a common member, this member illustratively being a metallic stiffener plate. Each of the drive circuits is connected to a corresponding one of the print element arrays. All the print element arrays are typically situated in a co-linear orientation transversely along the member with the drive circuits co-linearly arranged along a side of the arrays. In addition, both drive circuits in every pair of adjacent drive circuits are interconnected, through for example spreader boards mounted to said member along the same side of the print element arrays and outward of the drive circuits with wire bonds extending between adjacent spreader boards, such that all the drive circuits in the printhead are interconnected in a daisy-chained fashion.

22 Claims, 5 Drawing Sheets

LIGHT EMITTING DIODE PRINTHEAD HAVING IMPROVED SIGNAL DISTRIBUTION APPARATUS

TECHNICAL FIELD OF THE INVENTION

The invention relates to a printhead, particularly a light emitting diode (LED) printhead, that has improved apparatus for distributing signals to individual printing elements, i.e. LEDs, that are used in the printhead.

BACKGROUND ART

For many years, image reproduction technology has relied on, inter alia, first producing an image on a paper original and reproducing the original image using a xerographic based process. With the advent and increasingly widespread use of personal computers, such images increasingly contain computer generated graphics, such as pictures, charts, graphs and the like of one form or another. In forming an original depiction of such an image, a desired graphical image is often generated onto a sheet of paper or other suitable medium using an output device, such as a pen plotter or the like. This original depiction is then xerographically reproduced a desired number of times. Xerographic reproduction generally involves placing a paper original face down on a platen of a xerographic copier and then directing light onto the image depicted thereon at an appropriate angle such that light reflected therefrom will strike a surface of an appropriately charged moving photoconductive drum or belt (henceforth referred to as a photoconductor) as it passes through an internal exposure station within the copier. The reflected light, in turn, locally discharges the surface of the photoconductor such that a resulting electro-static charge pattern appearing thereon substantially matches the local visual reflectance characteristics that appear in the image. When the rotating photoconductor reaches an internal toning station within the copier, toner typically in the form of a powder is automatically applied to the photoconductor. The toner adheres to those portions of the surface of the photoconductor that remain charged. As the photoconductor continues to rotate, a sheet of paper is subsequently pressed against the rotating drum at a transfer station internal to the copier. An opposite charge is applied to the paper in order to transfer the toner pattern from the photoconductor to the paper. Thereafter, the paper is separated from the photoconductor typically through application of an appropriate charge thereto. Thereafter, the "toned" image is permanently fixed onto the paper at a so-called "fusing" station within the copier whereat the paper is passed between two heated rollers which melt the toner and fuse it into the paper.

Owing to the relatively large sized optical components typically used in a xerographic copier and the number and/or size of the necessary optical transmission paths internal to the copier, xerographic copiers tend to be physically large and rather bulky. Moreover, a user often wastes a significant amount of time by first employing a pen plotter or other similar device to generate an original image and then manually reproducing the image using a xerographic copier — the latter task includes bringing the original to a copier, waiting for the copier to generate the desired number of copies and then returning with the copies.

Therefore, in an effort to substantially increase the speed at which multiple copies of a image can be produced while reducing the size of an output device that produces these images, the art has turned to electronic imaging techniques. Generally, these techniques convert digital data directly into an image at a sufficiently high quality to rival present optical image reproduction techniques. In one such electronic imaging technique, digitized binary, gray scale or color image data provided by a computer or similar device, rather than light reflected off a paper original, is used to repeatedly discharge a photoconductor that through one or more separate toning passes respectively generates either a black and white or color image at a resolution that favorably compares with that produced by a optical xerographic copier. Specifically, the digital data is used, through appropriate driving circuitry, to energize individual diodes that exist within a linear array of light emitting diodes (LEDs) that collectively form a printhead. In response to the drive signals, the individual diodes generate light energy that when passed through a fiber optic lens assembly onto the surface of a moving photoconductor is sufficiently intense to locally discharge the surface of the photoconductor and establish a charge pattern thereon that mirrors a desired visual graphical pattern. To make multiple copies, this electro-optical imaging process is then repeated as often as necessary to directly generate the desired number of copies. Moreover, if an image that has been previously generated on paper or another medium is to be copied, that image can be read and digitized using a facsimile type scanner, stored within a digital memory circuit and subsequently and repeatedly printed using such a digital image printer to provide one or more copies.

To provide light energy that closely matches the spectral sensitivity of the photoconductor, gallium arsenide diodes that produce red light are used typically within the printhead. Unfortunately, present gallium arsenide fabrication technology suffers from a drawback that severely complicates the assembly of LED printheads.

Specifically, LED printheads generally require a single relatively long row, generally 11" (approximately 28 cm) or greater, of separate light emitting sites. Furthermore, to provide an appropriate level of detail in an output image which rivals that produced by xerographic or other image reproduction methods, LED printheads typically need a minimum resolution of 400 light emitting sites, i.e. individual LEDs, per inch (approximately 158 LEDs/cm). This necessitates that an 11" printhead must have at least approximately 4400 separate diodes aligned in a single row with a resulting $2.5 \cdot 10^{-6}$" (63.5 μm) center-to-center spacing between any two adjacent diodes. Unfortunately, current gallium arsenide fabrication methods have not reached the level of sophistication needed to produce semiconductor wafers in excess of typically 3" (approximately 7.6 cm) in diameter. Accordingly, the relatively small size of these wafers prevents a single 11" row of gallium arsenide LEDs from being fabricated on a single substrate. Hence, the art has turned to fabricating LED printheads using a sequence of individual arrays of gallium arsenide LEDs that are arranged in an abutting end-to-end fashion to form a single common line of closely spaced light emitting sites, in which each array contains multiple, e.g. 128, LEDs arranged along a single row. To ensure that the photoconductor will be uniformly illuminated along the entire width of the printhead, thereby ensuring to the extent possible that no artifacts due to uneven illumination will be imparted into an output image produced therewith, the individual LED arrays must be positioned on the printhead within extremely fine tolerances with respect to each other not only two-dimensionally across a common transverse axis on the printhead but also elevationally across the entire printhead, the latter ensuring that the printhead possesses a sufficient degree of mechanical flatness.

With this overall approach to implementing an LED printhead in mind, various specific techniques for actually implementing this approach are disclosed in the art. However, each of these techniques experiences various deficiencies that limit its use.

One technique, hereinafter referred to as the "ceramic substrate" technique for reasons that will become clear below and typified by the disclosure in U.S. Pat. No. 4,734,714 (issued to Takasu et al on Mar. 29, 1988), involves an LED printhead in which individual LED arrays, each having 96 light emitting sites, are each positioned on a relatively wide thick film conductive strip located along a central transverse axis of a surface of a fired alumina ceramic substrate. Staggered anode connections for all the diodes and associated metallized pads ("anode pads") therefor appear on the top of each array. The cathodes of all the individual LEDs within any array are internally connected to a common gold electrode on the reverse side of the array that abuts against the conductive strip. Each individual diode is approximately 0.04" by 0.31" (1 millimeter by 8 millimeter) and is arranged within an array at a center-to-center spacing of approximately $33.3 \cdot 10^{-6}$" (84.5 μm) between adjacent diodes. A pair of drive driving elements is associated with each individual array. The two elements that form any such pair are mounted directly to the substrate and on opposite sides of and generally perpendicular to the corresponding array. These driving elements contain appropriate shift registers and LED drive circuits. For any one array, one driving element in the pair associated therewith (situated in the so-called even half of the printhead) controls even number LEDs in that array, while the other driving element in the pair (situated in the so-called odd half of the printhead) controls the odd number LEDs in that array.

In this specific LED printhead, LED drive signals are routed from a connector situated near an edge of the substrate to various signal processing and line driver integrated circuits that are also mounted on the substrate. The output signals produced by the line drivers are applied through appropriate metallized busses situated on the surface of the substrate to drive driving elements for either the odd or even half of the printhead. The pitch of the output terminations of the driving elements is significantly greater than the narrow center-to-center pitch of the anode pads for the individual LEDs. Accordingly, for each driving element, a pattern of metallized interconnection leads ("interconnects") having a pitch that matches that of the driving element terminations is also fabricated on the surface of the substrate. These interconnects have pads at one end that are linearly aligned for connection to appropriate terminations of a driving element and have staggered metallized pads at the other end thereof for connection to corresponding individual metallized anode pads of the LEDs. One end of every interconnect is connected through a wire bond using relatively fine wire to an individual anode pad of an LED; while the other end of every metallized lead is connected through another wire bond to a corresponding drive module termination. Wire bonds, again with relatively fine wire, are also used to connect appropriate line driver terminations to the metallized busses. The metallized busses and interconnects are collectively formed by placing a gold thin film onto the alumina substrate followed by one or more separate conductive thick film and interspersed dielectric layers to form, where necessary, a multi-layered metallized pattern on the surface of the substrate. Flexible circuitry is used to route power from external circuit connections to multiple metallized leads situated on either side of the printhead. The substrate itself is affixed to a relatively large heatsink.

This specific technique for implementing an LED printhead is plagued by a number of serious deficiencies. First, long dimensionally accurate fired ceramic substrates that maintain flatness within acceptable tolerances across their entire length, such as 25 μm over 12" (approximately 30.48 cm), have proven to be extremely difficult to manufacture in large quantities. Inasmuch as low yields of acceptable substrates typically occur, each resulting substrate tends to be very expensive. Second, this approach requires a large number of wire bonds, typically in excess of 10,000 which are expensive and time-consuming to provide and also tend to reduce reliability of the printhead. Third, since the individual LED arrays are mounted through a thick film conductor to the actual ceramic substrate which, in turn, is mounted to a heatsink, a relatively high thermal resistance exists for heat dissipated from each diode, which, in turn, during sustained operation of the printhead raises the temperature and the failure rate of the individual LEDs therein. Fourth, inasmuch as a relatively high current is needed to drive the printhead, this current causes voltage drops to appear across the flexible circuits used to distribute power. Specifically, each diode in an operating printhead draws an average current of approximately 8 mA. Assuming every diode in the printhead is simultaneously energized, then an entire printhead containing 5000 such diodes draws approximately 40 amperes during the 50% on time of the duty cycle associated with all the diodes, with half of this current being distributed through flexible circuitry to the each of the even and odd halves of the printhead. Owing to the relatively small cross-section of the copper conductor(s) contained in the flexible circuitry used to route power to each half of the printhead, an appreciable voltage drop appears across this circuitry particularly when all or most of the diodes are energized. This voltage drop increasingly lowers the drive current available to power the diodes that are located at increasing distances down this circuitry and along the printhead such that "current starvation" is increasingly likely to occur for these diodes. Consequently, the printhead disadvantageously produces a non-uniform optical output across its length. Fifth, since all the driving elements and LED arrays are mounted to a common substrate, any subsequent failure in any of these driving elements or an LED array itself necessitates that manual repair techniques be used to replace a failed component, i.e. a driving element or an LED array, without damaging any of the other components on the substrate. This is generally an extremely difficult and expensive task. Moreover, since not every repair is successful or can be economically accomplished, the affected printheads including the large ceramic substrate and all the components mounted thereto, which are collectively quite expensive, are merely scrapped resulting in significant economic waste. Furthermore, if a driving element failed, all the relatively fine wire bonds connected to this driving element need to be manually removed, the driving element manually replaced and the bonds manually re-attached to a replacement drive module. This procedure is not only tedious, even when performed by skilled labor, but also the manual nature of this procedure renders it unsuitable for use of a mass production manufacturing environment.

In an effort to surmount these deficiencies associated with the "ceramic substrate" technique, the art has turned to another technique, hereinafter referred to as the "multi-module distribution board" technique for reasons that will become clear below, for fabricating LED printheads. Here, the printhead contains an assembly having a number of modules which are all mounted, typically using a conductive adhesive layer, to a metallic, typically stainless steel, support plate in an abutting horizontally aligned orientation with the support plate, in turn, being mounted to an aluminum heatsink. Each module has a metallic base plate ("tile") that is typically rectangular in shape with a vertical dimension that is somewhat larger than its horizontal dimension. The flatness of each of these metallic tiles can be much more easily maintained to the needed tolerance than can that of a large ceramic substrate.

Specifically, through the "multi-module distribution board" technique, an assembly of one or more LED arrays, illustratively three, is mounted onto a tile and located along a central transverse axis thereof with corresponding drive circuits situated on the tile close to and on opposing sides of each array and interconnected thereto through wire bonds, here at a relatively narrow pitch and using relatively fine wire. A ceramic or printed circuit spreader board is also situated on the tile and is located beyond and on either side of the drive circuits. A row of metallized fingers is typically located along a horizontal edge of the spreader board that is to be situated farthest from the drive circuits. The spreader boards are suitably dimensioned and appropriately situated on each tile such that a relatively small gap exists between one horizontal edge of the spreader board and the drive circuits while the other edge containing the metallized fingers overlays and is generally aligned with a corresponding horizontal edge, i.e. either the top or bottom edge, of the tile. Each spreader board contains a multi-layer metallized wiring pattern for interconnecting appropriate drive terminations to the appropriate metallized fingers. This wiring pattern matches the relatively narrow pitch of the drive terminations to a relatively broad pitch of the fingers and distributes appropriate LED drive signals, such as clocks and power, as input to the proper drive terminations. Metallized leads on the spreader board are connected by wire bonds, at the narrow pitch and again with using relatively fine wire, to appropriate drive terminations. In some current printhead implementations, each spreader board is typically a co-fired ceramic multi-layer thick film hybrid board which uses gold thin film layers for metallized bond pads and a relatively resistive conductor, such as tungsten, for the conductive layers. Dielectric layers are included in the spreader board such that a cross-over pattern of perpendicularly oriented conductive layers interconnected with appropriate feedthroughs (also known as "vias") is formed on each spreader board. This arrangement also includes a large conventional multi-layer laminate rectangular circuit board with a centrally located rectangular cut-out which is appropriately sized to substantially encircle the entire assembly of modules. This multilayer board, henceforth referred to as the "distribution" board, contains metallized busses, typically 25 or more, to distribute power and drive signals, the latter being produced by various signal processing and line driver integrated circuits located on the distribution board, to the proper fingers of each spreader board. Wire bonds, though here with a relatively wide pitch and a relatively large diameter wire, connect the appropriate busses on the distribution board with corresponding fingers on each spreader board. Power and incoming data and clock signals are supplied to the printhead through appropriate connectors typically situated on the distribution board and located relatively close to an edge thereof.

While the "multi-module distribution board" technique eliminates various drawbacks associated with the "ceramic substrate" technique, it nevertheless presents other drawbacks. Since the LED arrays are directly mounted through a metallic path to the heatsink, heat is more readily dissipated therefrom than in the "ceramic substrate" technique thereby beneficially lowering the failure rate of the LEDs. Furthermore, since each individual module can be fully tested after its assembly but prior to its being mounted to the support plate, the need to repair completed printheads substantially decreases. Moreover, whenever such a repair is needed, a complete module can be readily removed from the printhead and a replacement installed thereon. Inasmuch as this repair necessitates removing a small number of wire bonds that occur at a relatively wide pitch between the fingers on that module and the distribution board, installing a new module and then replacing these wide-pitched bonds, the cost and tedium associated with this repair advantageously is significantly less than that associated with replacing a failed component located on an LED printhead implemented using the "ceramic substrate" technique. However, though the "multi-module distribution board" technique eliminates the need to use a large ceramic substrate along with its attendant high cost, the "distribution" board is still expensive though less than the ceramic substrate. For example, wire bondable gold is generally used in a wire bond layer within the distribution board which increases its cost. In addition, if ceramic spreader boards are used, these spreader boards themselves tend to be costly. Nevertheless, the combined cost of a distribution board and all the required attendant spreader boards is often appreciably less than the cost of a large ceramic substrate. Second, the signal distribution lines running between and among both the distribution board and the spreader boards present complex impedance values, typically containing resistance, inductance and a significant amount of capacitance, that due to inherent charge and discharge times associated therewith limit the speed of clock and data signals that can propagate down the printhead and hence limit the speed at which the printhead can perform. Third, the cross-sectional area of the metallized busses situated on the distribution board that carry power to each half of the printhead still tends to be insufficient to eliminate an appreciable voltage drop that appears therealong during operation of the printhead. This voltage drop reduces the available drive current to the individual LEDs situated at increasing distances down from the printhead and, in turn, through current starvation causes a non-uniform optical output to appear along the printhead. Fourth, the distribution board is relatively large which disadvantageously increases the overall physical size of the printhead and any image printer that employs it.

Therefore, a need exists in the art for a printhead, such as an LED printhead, that tends to be smaller, and is simpler and less expensive to implement than such printheads known in the art. Moreover, the resulting LED printhead should provide a more uniform light output across its entire length than currently available printheads; operate at increased speeds than those associated with currently available printheads, particularly printheads implemented using the "multi-module distribution board" technique; have a relatively low thermal failure rate, and be relatively easy and inexpensive to repair. Such a resulting printhead will advantageously facilitate the evolution of relatively small and inexpensive electronic image printers.

DISCLOSURE OF THE INVENTION

The above-described deficiencies inherent in the art for providing a light emitting diode printhead are advantageously eliminated in accordance with the teachings of our present invention by a printhead that utilizes a number of print element arrays, typically arrays of light emitting diodes, and a corresponding number of drive circuits all of which are mounted to a common member, this member illustratively being a metallic stiffener plate. Each of the drive circuits is connected to a corresponding one of the print element arrays. All the print element arrays are typically situated in a co-linear orientation transversely along the member with the drive circuits co-linearly arranged along a side of the arrays. In addition, both drive circuits in every pair of adjacent drive circuits are interconnected to each other through interconnection means extending therebetween such that all the drive circuits in the printhead are connected in a daisy-chained fashion.

Specifically and in accordance with the teachings of a preferred embodiment of our invention, our inventive printhead has a number of substantially identical modules which are mounted to and situated side-to-side transversely across a surface of the stiffener plate, and are all interconnected in a daisy-chained fashion. Each module contains a number of arrays of individual light emitting diodes mounted to and in horizontal alignment along a central transverse axis of a metallic tile, a corresponding number of multi-channel drive circuits mounted to the tile and horizontally aligned into two rows that straddle the print elements, and preferably two spreader boards mounted to the same tile situated outward of and straddling the rows of drive circuits. All the modules are horizontally aligned such that a uniformly spaced co-linear arrangement of print elements is provided transversely across the printhead. Each spreader board contains a metallized wiring pattern that, in part, is used to extend electrical connections to the multi-channel drive circuits on the module. In addition, wiring interconnections, illustratively wire bonds or tape automated wiring bonds, are established between corresponding metallized bond pads on the wiring patterns on the spreader boards located within each pair of adjacent modules on the printhead such that substantially all the modules situated on the support member and specifically the spreader boards located in each half of the printhead are interconnected in a daisy-chained fashion. In addition, to substantially reduce the occurrence of current starvation occurring among individual light emitting diodes situated along the printhead, power is supplied in parallel to the modules through a separate bus bar assembly, that has multiple bus bars, which is mounted to all horizontally aligned spreader boards situated along and in each half of the printhead. This daisy-chained interconnection eliminates the need to use a large printed circuit board ("distribution board") within the printhead in order to distribute signals to each module thereby advantageously reducing the complexity, size and cost of the printhead.

Moreover, since our inventive printhead utilizes daisy-chained wiring in lieu of a large multi-layer circuit board to distribute signals to individual modules, each individual daisy-chained signal distribution lead used in our inventive printhead presents less end-to-end capacitance and inductance than does a signal distribution lead running between and among both a distribution board and the individual spreader boards used in the "multi-module distribution board" technique. Accordingly, our inventive printhead provides reduced signal propagation times from one end of the printhead to the other thereby permitting this printhead to operate at an increased speed over a printhead implemented through the "multi-module distribution board" technique.

BRIEF DESCRIPTION OF THE DRAWINGS

The teachings of the present invention may be readily understood by considering the following detailed description in conjunction with the accompanying drawings, in which.

To facilitate understanding, identical reference numerals have been used, where appropriate, to denote identical elements that are common to various figures.

MODES OF CARRYING OUT THE INVENTION

After reading the following description, those skilled in the art will readily appreciate that the "daisy-chained" signal distribution technique taught by the present invention can be used in a wide variety of optical, thermal or other type(s) of printheads that contain one or more relatively long linear arrays of printing elements. Inasmuch as our inventive apparatus is particularly well suited for use in a printhead that contains a single linear array of individual light emitting diodes (LEDs), we will now describe our invention in that context.

Figure 1:
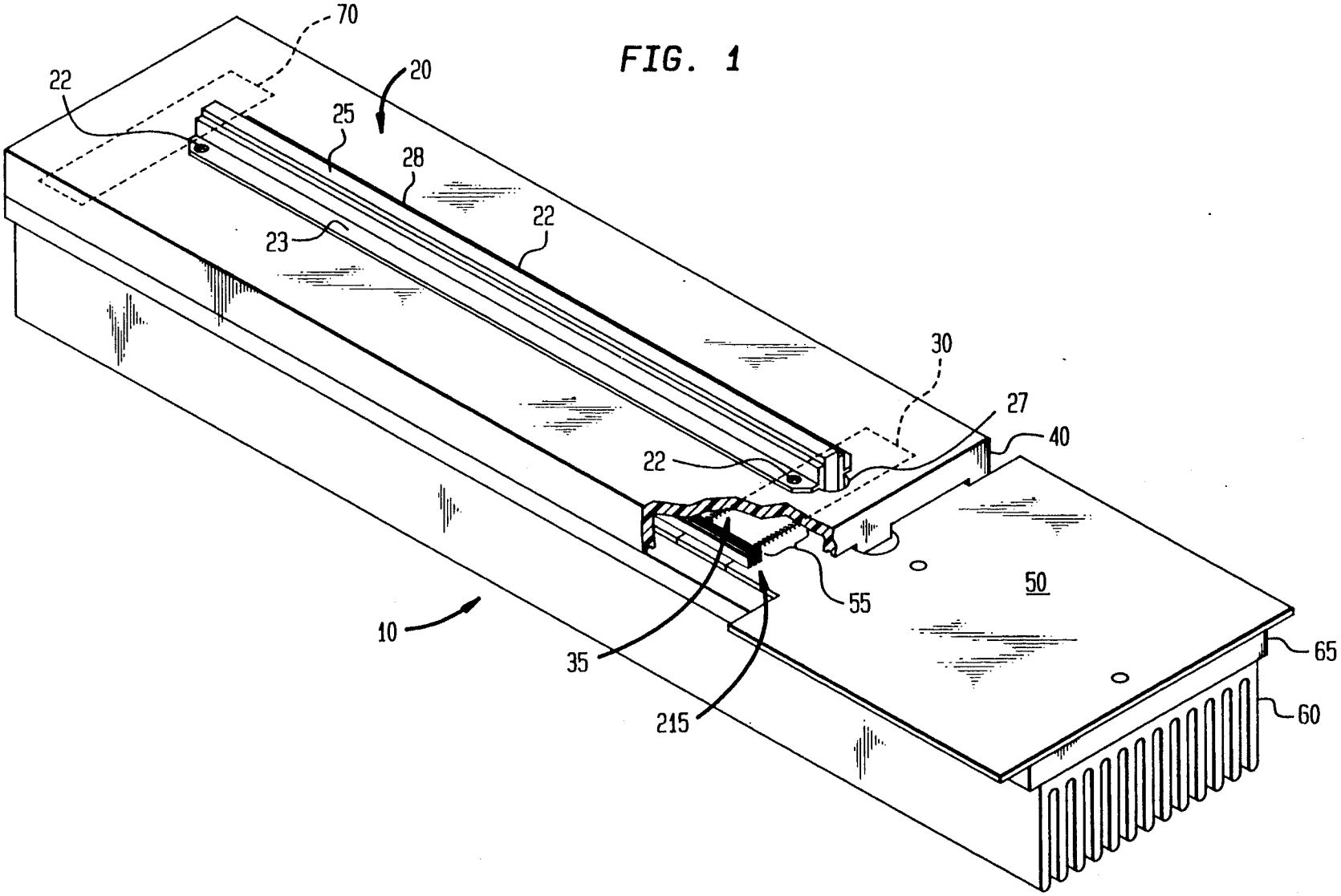
FIG. 1 depicts a partial cutaway perspective view of a preferred embodiment of light emitting diode (LED) printhead 10 constructed in accordance with the teachings of the present invention.

A partial cutaway perspective view of a preferred embodiment of light emitting diode (LED) printhead 10 constructed in accordance with the teachings of the present invention is depicted in FIG. 1. As shown, printhead 10 contains a horizontally abutting series of modules, of which only module 30 is specifically shown in dotted outline. These modules are mounted on a top surface of stiffener (support) plate 65, typically through use of a thin conductive adhesive layer that has a good thermal conductance (well known and not specifically shown) and is applied to the underside of each module and to appropriate locations on the top surface of the plate. The stiffener plate, in turn, is abutted against heatsink 60, with a thin layer of conductive thermal paste situated therebetween. To facilitate air cooling, heatsink 60 has a number of downwardly projecting fins that run along its length. Each module contains, as will be described in detail below, a number, here three, of horizontally aligned LED arrays, accompanying drive circuits and spreader boards — all of which are not specifically shown in FIG. 1. The diode arrays are situated along a central transverse axis of each module. To appropriately focus light generated by each individual diode onto a separate corresponding location along a transverse line on a surface of a rotating photoconductor, such as a photoconductive drum or belt (well known and not shown), lens 20 containing transversely oriented array 25 of optical fibers is placed over and in vertical alignment with the horizontally aligned LED arrays contained in all the modules. The orientation of array 25 is maintained normal to the plane of the LED arrays through support members 23 and 28 which are affixed to respective sides of the optical array. This optical fiber array is preferably a SELFOC graded index optical fiber array manufactured by Nippon Sheet Glass, Limited of Japan (which also owns the trademark SELFOC). Lens 20 extends downward through substantially rectangular cutout 27 formed in housing 40 towards the surface of all the LED arrays. Lens 20 can be secured to housing 40 through appropriate screws or other fasteners inserted through holes 22, located in support members 23 and 28, which mate with appropriately aligned and threaded holes in the housing.

Interface board 50 which is mounted to a portion of the top surface of stiffener plate 65 and contains appropriate input connectors and various signal processing and line driver integrated circuits (all of which are conventional, well known and for simplicity not shown in the figure). The board routes appropriate digital data, clock and power signals to each of the modules that forms the printhead in order to energize individual LEDs therein in a proper temporal and positional sequence so as to provide an electro-static charge pattern on the surface of the photoconductor that, during a subsequent toning pass, will produce a desired visual image on a piece of paper. Suitable termination board 70 is typically situated within the printhead and aligned with the series of modules, mounted to a portion of the stiffener board and connected, also by wire bonds, to the opposite end of the series of modules as is the interface board. The termination board contains well known line terminations, such as resistors or resistor/capacitor pairs or other electronic components, designed to balance the transmission line characteristics of certain individual daisy-chained signal lines which operate at a sufficiently high frequency that, if left unterminated, would suffer from well known unbalanced transmission line effects, such as impedance mismatches and signal reflections. Termination board 70 may also contain power line decoupling capacitors. Alternatively, the functionality of the termination board can be obtained by mounting various components, that would have been situated on the termination board, onto the module located farthest from the interface board in the printhead. Unfortunately, this arrangement necessitates that one module will be different from the rest, which complicates production and testing. Furthermore, depending upon the size of a module, the module may not possess sufficient spare room to accommodate the additional components.

Unfortunately, signal and power distribution techniques known in the art for use in printheads, particularly LED printheads, suffer from various drawbacks which, for example, either significantly complicate and hence frustrate the manufacture and repair of the printhead and increase the price therefor, and/or limit the performance of the printhead, such as by unduly restricting the speed at which the printhead can operate and/or imparting non-uniformities into the amount of light generated along the printhead.

In accordance with our invention, we have substantially overcome many of the deficiencies inherent in LED printheads known in the art and specifically those deficiencies caused by signal and power distribution techniques that are conventionally used in LED printheads fabricated using either the "ceramic substrate" or "multi-module distribution board" techniques.

Our inventive printhead utilizes a number of print element arrays, typically arrays of light emitting diodes, and a corresponding number of drive circuits all of which are mounted to a common member, this member illustratively being a metallic stiffener plate. Each of the drive circuits is connected to a corresponding one of the print element arrays. All the print element arrays are typically situated in a co-linear orientation transversely along the member with the drive circuits co-linearly arranged along a side of the arrays. In addition, both drive circuits in every pair of adjacent drive circuits are interconnected to each other through interconnection means extending therebetween such that all the drive circuits in the printhead are connected in a daisy-chained fashion.

Specifically and in accordance with the teachings of a preferred embodiment of our invention, our inventive printhead has a number of substantially identical modules which are mounted to and situated in a side-to-side orientation transversely across a surface of the stiffener plate and are all interconnected in a daisy-chained fashion. Signals are distributed through spreader boards utilized within each module to either the odd or even numbered LEDs contained therein, with each such spreader board being connected in a daisy-chained arrangement, using for example wire-bonds or tape automated bonding, to other spreader boards situated horizontally adjacent thereto. Wire bond pads (henceforth also referred to as "interconnect" pads) are provided along both vertical (side) edges of each spreader board to facilitate the formation of daisy-chain connections using relatively short wire bonds between adjacently situated spreader boards and between a first spreader board and an adjacently situated interface board and between a last spreader board and an adjacently situated termination board. For a full discussion of tape automated bonding, the reader is referred to U.S. Pat. No. 4,851,862 issued Jul. 25, 1989 and entitled "LED Array with Tab Bonded Wiring" which is owned by the present assignee and which is incorporated by reference herein. These daisy-chained connections are used to distribute digital signals, such as data and clock signals, to the individual drive circuits contained within the module. Wire bond pads are also located along the top edge of each spreader board for use in connecting appropriate drive circuit terminations thereto. To substantially reduce the incidence of current starvation that may occur among individual LEDs along the printhead, power is distributed among the individual modules not by daisy-chained connections extending between adjacent spreader boards but rather through use of bus bars that are connected in parallel to all the spreader boards used in both the odd or even halves of the printhead. These bus bars are connected to each spreader board near its bottom edge thereof. Each spreader board provides a multi-layered metallized cross-over wiring pattern that matches a pitch associated with appropriate terminations on the drive circuits to a pitch associated with the daisy-chained wire bond pads. Within each module, the LED arrays, illustratively three in number, are mounted directly to a substantially rectangular metallic, typically stainless steel, base plate or pallet (also referred to as a "tile") in a horizontal abutting alignment and along a common central transverse axis of that tile. Corresponding drive modules, illustratively six in number, are also mounted directly to the tile with three such modules located on each side of the LED arrays. In addition, spreader boards, illustratively two in number, are mounted one on each side of the tile outward of the drive circuits. Within any module, wire bonds interconnect the spreader boards, drive circuits and LED arrays contained therein. The spreader boards, drive circuits and LED arrays are all mounted to a common surface of a tile, with the opposite surface thereof abutting against stiffener plate 65. Each tile provides a common cathode connection to the LEDs mounted thereon as well as a path with a low thermal resistance (as compared to that possessed by a ceramic tile) to quickly conduct heat from the LED arrays and drive circuits through the stiffener plate into the heatsink.

Use of our inventive technique which employs daisy-chained modules advantageously eliminates the need to use a large ceramic substrate and its attendant manufacturing and repair difficulties, increased thermal failure rates and high cost, or, in comparison to other well known prior art techniques, the need to use a large multi-layer distribution board to distribute power and digital signals among the individual modules thereby simplifying the manufacture and repair of the printhead and lowering the cost therefor, and significantly decreasing the overall physical size of the resulting printhead. In addition, by eliminating the distribution board, the daisy-chained signal distribution leads in the spreader boards present significantly less end-to-end capacitance and inductance than do the signal distribution leads implemented in the "multi-module distribution board" technique, thereby advantageously permitting the printhead implemented with our inventive technique to operate at increased speeds over printheads implemented using the "multi-module distribution board" technique.

With our inventive technique in mind, interface board 50 is connected to module 30, and specifically to the spreader board therein, at the right side thereof through wire bonds 55. Similar wire bonds 35, existing on the left side of module 30, interconnect this module to its neighboring module abuttingly situated thereat. In this fashion, successively occurring modules running towards the left end of the printhead and the termination board are interconnected with their immediately adjacent neighboring modules through wire bonds situated therebetween such that all the modules in the printhead are daisy-chained together, with the rightmost and leftmost modules respectively being daisy-chained to the interface and termination boards, for purposes of propagating digital data and clock signals thereto from interface board 50 through all the modules to termination board 70. As noted above, only certain data and clock signals that possess a sufficiently high frequency extend past the modules to and are terminated by the termination board. Rectangular shaped bus bar assembly 215 which contains three individual bus bars each having a relatively wide cross-sectional shape, as compared to the metallized leads on the spreader boards, and which provide parallel connections is affixed to the spreader boards in these modules to route power signals, illustratively two different voltage levels ($V_{cc}$ and $V_{dd}$) and ground, to each of these spreader boards from the interface board. Identical daisy-chained wire bonds and identical bus bar assemblies are used in both the even and odd halves of the printhead to interconnect the spreader boards therein. To simplify FIG. 1, only the daisy-chained wire bond connections and bus bar assembly for the spreader boards in the even (lower) half of the printhead are expressly shown therein.

Figure 2:
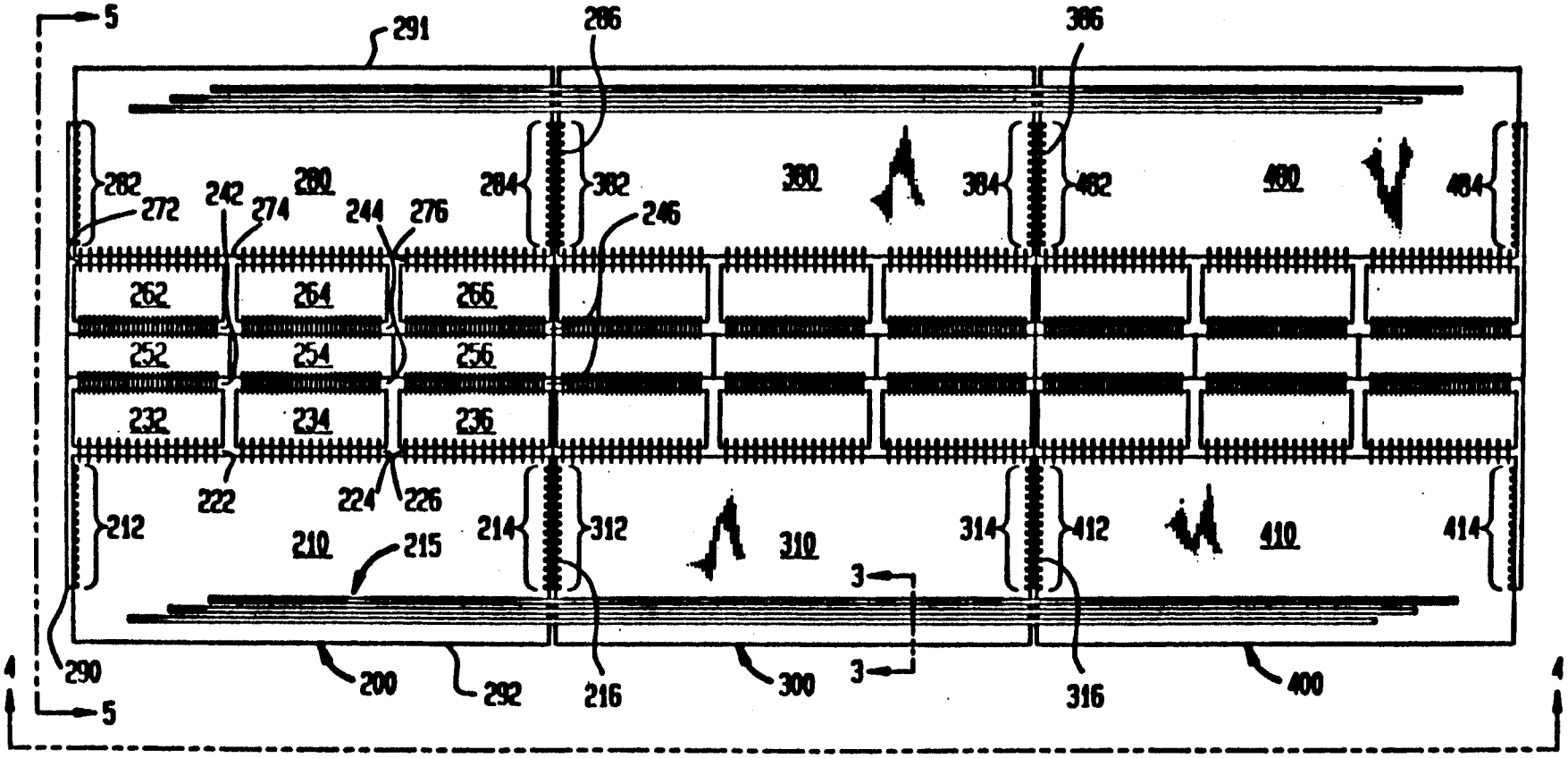
FIG. 2 is a simplified top view of three illustrative adjacent modules contained within printhead 10 shown in FIG. 1 and daisy-chained wire bond connections existing between any two adjacent modules and parallel bus bars existing therebetween.

FIG. 2 is a simplified top view of a series of three illustrative modules 200, 300 and 400 contained within printhead 10 shown in FIG. 1 along with daisy-chained wire bond connections existing between any two adjacent modules and parallel bus bars existing therebetween. Inasmuch as all the modules used in a printhead are identical in size and content, specifically including the three modules shown in FIG. 2, the following discussion will center on module 200.

Module 200 contains LED arrays 252, 254 and 256 arranged along a central axis of tile 290 and affixed thereto in a horizontally abutting relationship with respect to each other. Tile 290 is substantially rectangular in shape, though it can be substantially square, and has a relatively thin rectangular cross-section. The tile can be any of a wide variety of sizes through in any one application its size is governed to within a relatively fine tolerance by the physical size of the LED arrays, drive circuits and spreader boards that will be mounted thereto. Each LED array illustratively contains 128 linearly arranged individual gallium arsenide LEDs with a center-to-center spacing of 0.0025" (approximately 0.0064 cm) between any two adjacent diodes. A 12" (approximately 30.5 cm) printhead contains 13 such modules which collectively provide a total of 39 identical LED arrays which, in turn, provide 4992 individual diodes (light emitting sites).

Drive circuits 232, 234 and 236; and 262, 264 and 266 are directly mounted to tile 290 respectively below and above the LED arrays and are oriented substantially parallel thereto. All the drive circuits are each integrated circuit drive chips or packages and are identical with each circuit illustratively containing 64 separate drive channels. Wire bonds 242, 244 and 246, which are at a relatively fine pitch of the LED anode pads (not specifically shown), connect the individual LEDs in these arrays to the corresponding drive circuits. Separate spreader boards 210 and 280 are mounted to tile 290 below and above these drives, respectively. Wire bonds 222, 224 and 226 connect appropriate terminations on drive circuits 232, 234 and 236 to metallized bond pads (not specifically shown in FIG. 2) situated on spreader board 210. These pads route both digital data and clock signals as well as power to these individual drive circuits. Similarly, wire bonds 272, 274 and 276 connect appropriate terminations on drive circuits 262, 264 and 266 to metallized bond pads (also not specifically shown in FIG. 2) situated on spreader board 280. The wire bonds connecting the drive circuits to the spreader boards typically have a significantly larger pitch than that associated with the wire bonds interconnecting the drive circuits and the LED arrays, thereby facilitating assembly.

Spreader boards 210 and 280, which are both directly mounted to and overlap top and bottom horizontal edges 291 and 292 (see FIG. 5) of tile 290, respectively contain interconnect pads 212 and 214, and 282 and 284, as shown in FIG. 2, which are oriented along a corresponding vertical (side) edge of these boards. As a new module is positioned on stiffener plate 65 (see FIG. 1) and abutted against either interface board 50 or a previously installed module, the new module is properly oriented such that each of its interconnect pads is horizontally aligned with a corresponding interconnect pad on either the interface board or the previously installed module, respectively. After all the modules have been appropriately mounted onto the stiffener plate, termination board 70 is then appropriately mounted thereto and in alignment with the last, i.e. farthest (leftmost as shown in FIG. 1) module. Once the new module is appropriately oriented, a wire bond, which is one form of a "wired interconnection", is installed between each interconnect pad thereon and each corresponding interconnect pad on the previous module or interface board. For example, once module 300, shown in FIG. 2, is installed, wire bonds 286 and 216 are extended between each pair of horizontally aligned adjacent pads in interconnect pads 284 and 382, and 214 and 312, respectively, on spreader boards 280 and 380 and spreader boards 210 and 310 on corresponding modules 200 and 300. Similarly, once module 400 is installed, wire bonds 386 and 316 are extended between each pair of horizontally aligned adjacent pads in interconnect pads 384 and 482, and 314 and 412, respectively, on spreader boards 380 and 480 and spreader boards 310 and 410 on corresponding modules 300 and 400, and so on using interconnect pads 484 and 414 for the next spreader board. As a result of these wire bonds running between interconnect pads of adjacent spreader boards, all the spreader boards are connected in a daisy-chained, i.e. series, configuration. Alternatively, all the modules and the interface and termination boards may first be mounted to the stiffener plate 65 with wire-bonds then being extended therebetween. To facilitate manufacture, each spreader board can be made wider in the vertical (Y) direction than in the horizontal (X) direction in order to increase the spacing between adjacent interconnect pads and to permit use of increasingly wide conductor runs in the multi-layer wiring pattern situated on the board. Spreader boards 210 and 280, drive circuits 232, 234, 236 and 262, 264 and 266 along with LED arrays 252, 254 and 256 are all mounted to a common surface of tile 290.

After all the spreader boards have been installed onto the stiffener plate, bus bar assemblies 215 and 285 are affixed to each module. Each of these bus bar assemblies, as described in detail below, contains three separate parallel metallic conductors (bus bars) having a rectangular cross-section shape with dielectric layers interspersed therebetween to carry two different voltage levels, i.e. $V_{cc}$ and $V_{dd}$, and ground to each spreader board in either half of the printhead. In this regard, bus bar assemblies 215 and 285, only a portion of which is specifically shown in FIG. 2, supply power and ground respectively to spreader boards 210, 310, 410 in, for example, the even half of the printhead and to spreader boards 280, 380 and 480 in the odd half of the printhead. The height of each tile is appropriately sized such that distance over which the edges of a spreader board overlaps the tile is sufficiently large to prevent connection pins of the three individual bus bars in a bus bar assembly which extend through the spreader board from contacting the tile to which the spreader board is mounted and thereby shorting together or to the LED arrays mounted to that tile.

Figure 3:
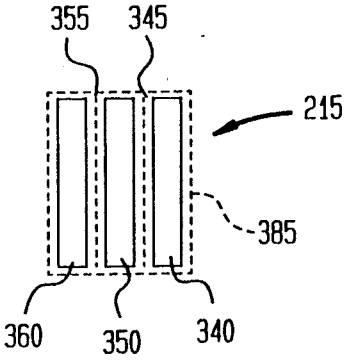
FIG. 3 is a cross-sectional view of bus bar assembly 215 taken along lines 3—3 shown in FIG. 2.

As to the bus bar assemblies themselves, FIG. 3 shows a cross-sectional view of bus bar assembly 215 taken along lines 3—3 shown in FIG. 2. As shown, bus bar assembly 215 contains individual metallic bus bars 340, 350 and 360, each of which has a rectangular cross-sectional shape of sufficient size to present a relatively negligible resistance from one end of the bus bar to the other to the flow of one half of full drive current, e.g. approximately 20–25 amperes, that is to be supplied to the print head. All the bus bars are identical with exception of the location of their connection pins. Interspersed between the conductive bus bars themselves are dielectric layers 345 and 355, here represented by dashed lines, and formed of a suitable well-known solid dielectric material. In addition, all the outside surfaces of the bus bars are coated with a suitable dielectric material as shown by dashed lines 385.

Figure 4:
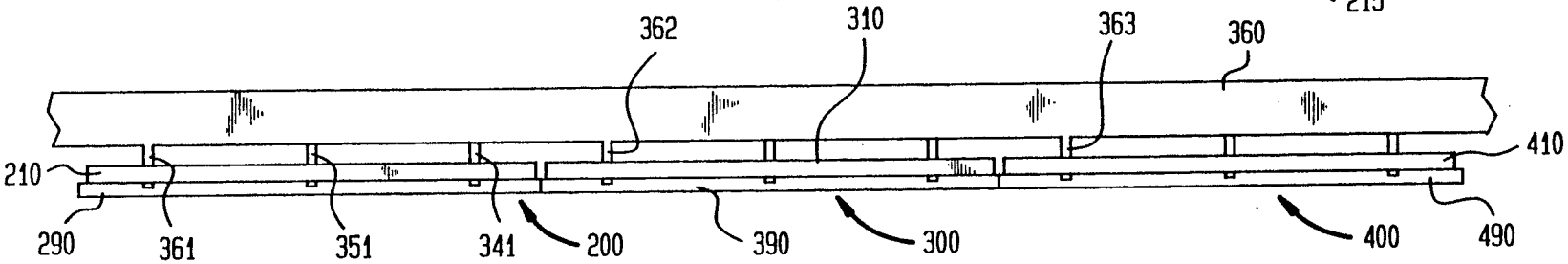
FIG. 4 is a front elevational view of illustrative modules 200, 300 and 400 taken along lines 4—4 also shown in FIG. 2.

FIG. 4 depicts a front elevational view of illustrative modules 200, 300 and 400 taken along lines 4—4 shown in FIG. 2. As shown in FIG. 4, modules 200, 300 and 400 contain spreader boards 210, 310 and 410 mounted directly to tiles 290, 390 and 490, respectively. Bus bar 360 which forms part of bus bar assembly 215 (see FIGS. 2 and 3) supplies a specific voltage level to the spreader boards in the even half of the printhead assembly including spreader boards 210, 310 and 410. Bus bar 360, as shown in FIG. 4, is connected to each one of spreader boards 210, 310 and 410 situated in one half, illustratively the even half, of the printhead through appropriate connection pins, such as pins 361, 362 and 363, that downwardly extend from this bus bar at regular periodic intervals therealong and are each inserted in and electrically secured to a corresponding electrical thru hole in spreader boards 210, 310 and 410, respectively, and so on for all the other spreader boards in the even half of the printhead. Owing to the use of three different bus bars to supply two different voltage levels and ground to each spreader board in each half of the printhead, three pins — one from each of the bus bars, such as pins 341, 351 and 361 collectively extending from bus bars 340, 350 and 360 — situated in a staggered positional relationship thereamong extend through and are electrically connected to each spreader board in that half, such as spreader board 310, in order to supply these voltage and ground levels thereto.

Figure 5:
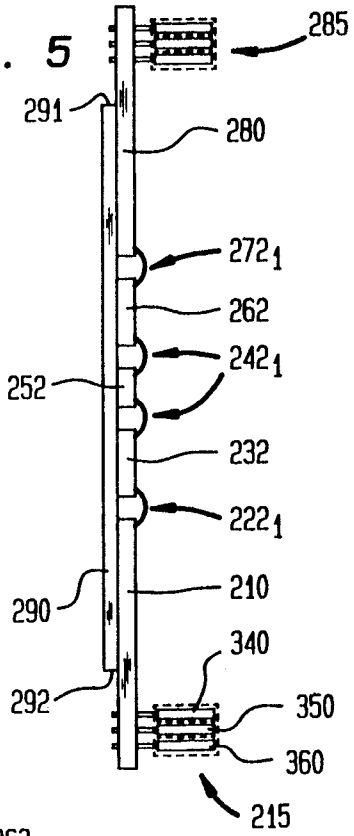
FIG. 5 is a side view of illustrative module 200 taken along lines 5—5 shown in FIG. 2.

FIG. 5 is a side view of illustrative module 200 taken along lines 5—5 shown in FIG. 2. As depicted in FIG. 5, this view shows tile 290 to which LED array 252 is mounted along a central transverse axis thereof along with drive circuits 232 and 262 which are mounted to this tile on either side of this array. Spreader boards 210 and 280 are mounted to tile 290 outward of the drive circuits and extend beyond the edge thereof. Bus bar assemblies 215 and 285, with assembly 215 containing bus bars 340, 350 and 360, are respectively connected to spreader boards 210 and 280. Wire bonds 222 and 272, of which respectively only one such bond $222_1$ and $272_1$ is specifically shown, connect these two drive circuits to the spreader boards. Wire bonds 242, of which only two such bonds $242_1$ are specifically shown, connect LED array 252 to two drive circuits 232 and 262.

Figure 6:
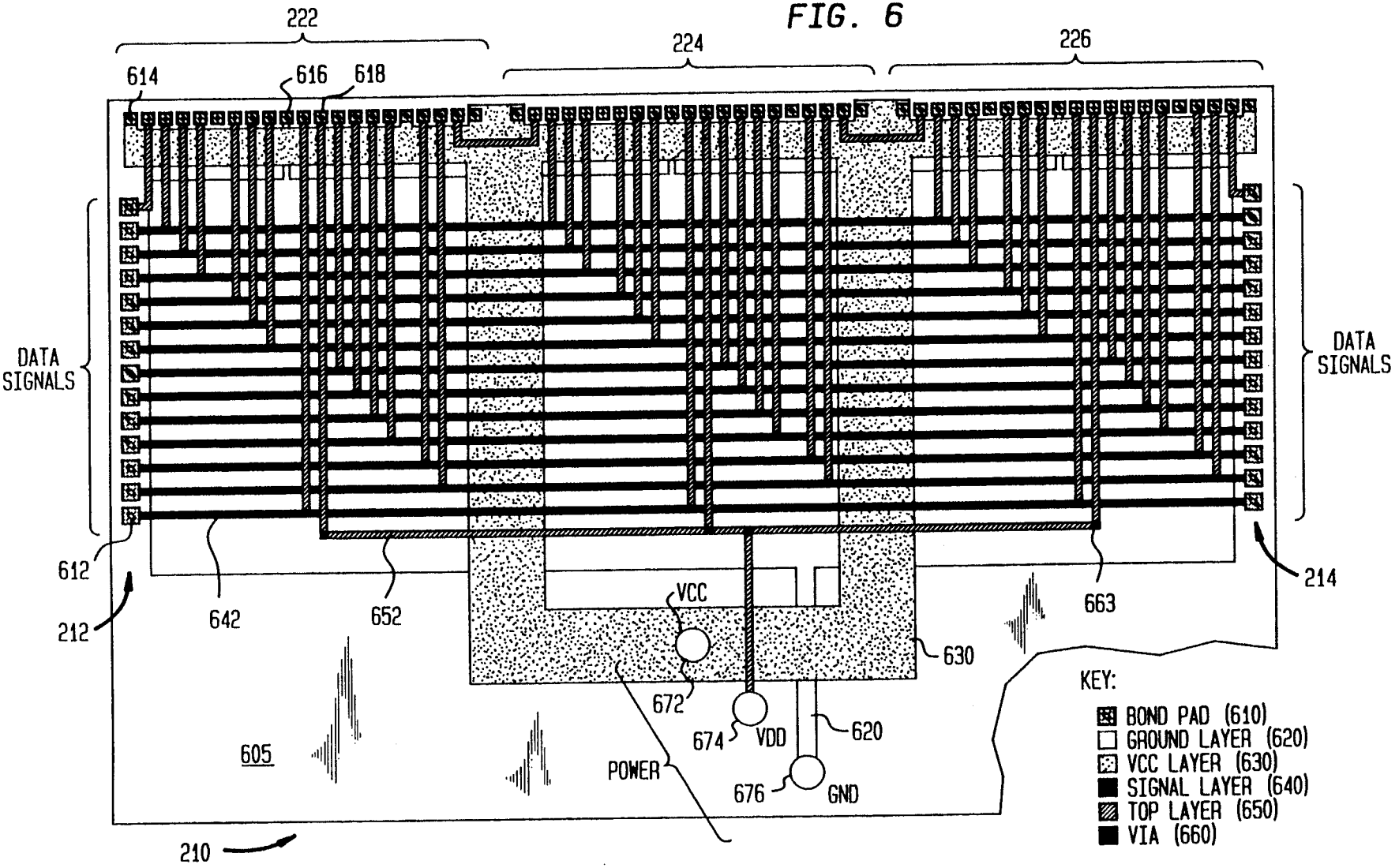
FIG. 6 is a simplified top view of illustrative spreader board 210 shown in FIG. 2 and a multi-layer metallization pattern appearing thereon.

FIG. 6 provides a simplified top view of illustrative spreader board 210 shown in FIG. 2 and the multi-layer metallization pattern appearing thereon. Specifically, as shown in FIG. 6, spreader board 210 is formed of rectangular ceramic substrate 605 having six distinct metallized wiring patterns situated therein. Specifically, bond pads 610, of which bond pad 612 is illustrative, and ground layer 620 are fabricated as the bottom layer on the substrate. $V_{cc}$ layer 630 overlies the ground layer. Appropriate metallization extends from ground layer 620 and $V_{cc}$ layer 630 to interconnect these layers to corresponding pads within bond pads 222, 224 and 226, specifically and illustratively bond pad 614 and 616 which are respectively interconnected to $V_{cc}$ layer 630 and ground layer 620. Buried signal layer 640, containing illustrative path 642, overlays $V_{cc}$ layer 630. This signal layer is formed of metallized conductors which run between metallized bond pads 212 and 214 and are used to carry data signals therebetween. Overlaying buried signal layer 640 is top layer 650. The top layer contains metallized conductors which connect to appropriate metallized conductors in layer 640 to carry data signals to appropriate pads in bond pads 222, 224 and 226 for connection to corresponding terminations on drive circuits 232, 234 and 236 wire bonded thereto (see FIG. 2). As shown in FIG. 6, layer 650 also carries voltage $V_{dd}$ to appropriate pads, such as illustrative pad 618, within bond pads 222, 224 and 226 for application to these drive circuits. Metallized vias 660, of which via 663 is illustrative, are used to form interconnections between adjacent layers. Furthermore, each spreader board contains staggered metallized thru holes 672, 674 and 676 that are respectively connected to $V_{cc}$ layer 630, top layer 650 and ground layer 620 and which collectively connect to bus bar assembly 215 (see FIG. 2) in order to appropriately route power, i.e. voltage levels $V_{cc}$ and $V_{dd}$ and ground, from the bus bar assembly to the drive circuits connected to this board.

Although not specifically shown in FIG. 6, a suitable well-known dielectric layer is interposed between each pair of adjacent metallized layers. Moreover, all the layers, both metallized and dielectric, are fabricated using suitable conventional techniques that are well known in the art. While the ordering of the layers shown in this figure conforms to conventional standard layer stacking rules taught in the art to design multilayer circuit boards, the actual ordering that can be used on any spreader board is not critical and can be different from that shown in FIG. 6 provided that all the bond pads come to the surface of the spreader board so that appropriate wired interconnections, illustratively wire bonds, can be made thereto both between adjacent spreader boards and between a spreader board and the associated drive circuits that are to be connected thereto. In addition, while various metallized conductors that are used in various adjacent layers in FIG. 6 are shown as being oriented essentially perpendicular to each other, these conductors, in actuality, need not be oriented in only this fashion. The orientation that can be used in any given spreader board will be governed in a well-known fashion by the nature of the signals that are to appear on these layers thereon and the amount of cross-talk that can be tolerated therebetween.

Furthermore, although top layer 650 of the spreader board contains conductors that, run essentially perpendicular from conductors in buried signal layer 640, to bond pads 222, 224 and 226 for connection to the individual drive circuits, the top layer and bond pads 222, 224 and 226 can be eliminated in favor of directly interconnecting each conductor in layer 640 with wire bonds to each appropriate termination on drive circuit. Though this approach retains daisy-chained interconnections, via bond pads 212 and 214, between adjacent modules, it does so at the expense and difficulty of using non-uniform wire bonds between layer 640 and the drive circuits in each module.

Those skilled in the art recognize that any signal distribution technique used in a printhead requires that adequate time must be provided after a signal is supplied to any signal distribution line in order to permit the signal to substantially charge the entire length of that line and allow an electrical level appearing thereon to reach a steady state condition over the entire line before the signal is removed. Doing so permits the signal to fully propagate down the distribution line and reach the farthest drive circuit in the printhead connected thereto. This charge time, of course, tends to limit the maximum speed at which the printhead can be operated. This is true for any printhead. Clearly, those skilled in the art, now realize that use of daisy-chained interconnections between the individual spreader boards as taught by our invention provide significantly less end-to-end capacitance and inductance than do signal distribution lines that are used in the "multi-module distribution board" technique and therefore require less charge time provided the spreader boards are designed to have dielectric layers with appropriate layer thicknesses and conductive layers with appropriate resistances. Accordingly, use of our technique permits the printhead to operate at speeds in excess of the maximum speeds associated with printheads implemented through the "multi-module distribution board" technique. To provide even faster speeds, various, if not all, daisy-chained interconnections can be modified to include a suitable terminating resistor at both ends of each complete interconnect, i.e. within the interface and termination boards in the printhead, matched to the impedance of the interconnect in order to substantially reduce, if not totally eliminate, any undesirable signal reflections that might occur at either end of the entire interconnection. In addition, suitable resistor(s) can be mounted to each interconnection on every spreader board to eliminate any such reflections that might occur at an interconnect wire bond point. Moreover, two balanced lines with appropriate terminating resistors can be used to form one or more complete daisy-chained interconnections. Furthermore, to accommodate even greater speeds, one or more of the daisy-chained interconnections can be implemented using a daisy-chained stripline type transmission line or other similar transmission technique along with corresponding terminating resistors and preferably appropriate repeaters located on various spreader boards positioned along the length of the printhead to maintain the level of the signal propagating down the interconnection.

Serial, i.e. daisy-chained, connections to the transmission line from one spreader board to the next could be accomplished in any manner, such as through a coaxial interconnect (another form of a "wired interconnection") rather than a simple wire bond, that presents an impedance that matches that of the transmission line and thereby introduces minimal, if any, reflections into the line as a signal propagates thereacross from one spreader board to the next. Furthermore, different interconnections extending through the spreader boards could be implemented using different wiring techniques depending upon the frequencies of the signals that will be transmitted therealong; the interconnections that are to carry relatively slow signals could be implemented using single conductors and wire bonds between adjacent spreader boards and without the need for terminating resistors, while those interconnections that are to carry relatively high speed signals could be implemented through balanced lines, stripline transmission lines or the like along with use of suitable terminating resistors. Other well-known forms of "wired interconnections", such as ribbon cable or tape automated bonding, could also be used where appropriate between adjacent spreader boards.

Although our invention, as described above, utilizes a spreader board that contains no components other than a multi-layer wiring pattern, each such spreader board can be readily modified, as required, to include additional components such as but not limited to a power decoupling capacitor(s), a terminating resistor(s) and even another circuit(s), such as illustratively dedicated digital logic or even a local digital processor or the like for use in processing data supplied via that spreader board to the drive circuits connected thereto.

Furthermore, although the invention has been described in terms of a spreader board that accommodates three drive circuits, each spreader board that utilizes daisy-chained interconnections can be readily designed and manufactured to accommodate any different number of drive circuits. The size of the spreader board will likely be governed by module size which, in turn, is governed by various considerations of, inter alia, ease of manufacture and repair, and cost. In addition, each module can be easily sized to contain a different number of LED arrays, a different number of individual drive circuits as well as a different number of LED drive channels in each such circuit, and a differently sized spreader board than that described above, all as required by a given printhead being designed.

Moreover, although each spreader board has been described above as having a ceramic substrate with an overlaid multi-layer metallized wiring pattern, such a spreader board can implemented using any conventional multi-layer circuit board laminate insulating material, such as a conventional glass epoxy laminate board, or other insulating material, such as glass or plastic, with an overlaid metallized wiring pattern. The multi-layer wiring pattern can also be implemented using any conventional well-known technique including but not limited to thin film, thick film or additive plated wiring (so-called "mid-film"). The specific wiring technique used on a given spreader board will likely be governed by, inter alia, the desired pitch (line width and line space width) of the metallized leads that need to appear on the spreader board. A wiring technique that provides an increased wiring density is likely to be required where the printhead is to have gray scale control. Here, the light intensity produced by each LED is to be controlled in a quantized fashion over a finite range so as to produce a desired gray scale output therefrom. Inasmuch as multiple bits would be supplied to each drive channel in a drive circuit in order to control the light intensity provided by each individual LED connected thereto, either through e.g. control of the duty cycle of its drive voltage or through direct application thereto of binary quantized drive levels, a suitably fine wiring pitch is required that accommodates an increased number of signal leads applied to each drive channel in the drive circuit in lieu of a single control lead for each separate drive channel as used in the drive circuits described above.

Figure 7:
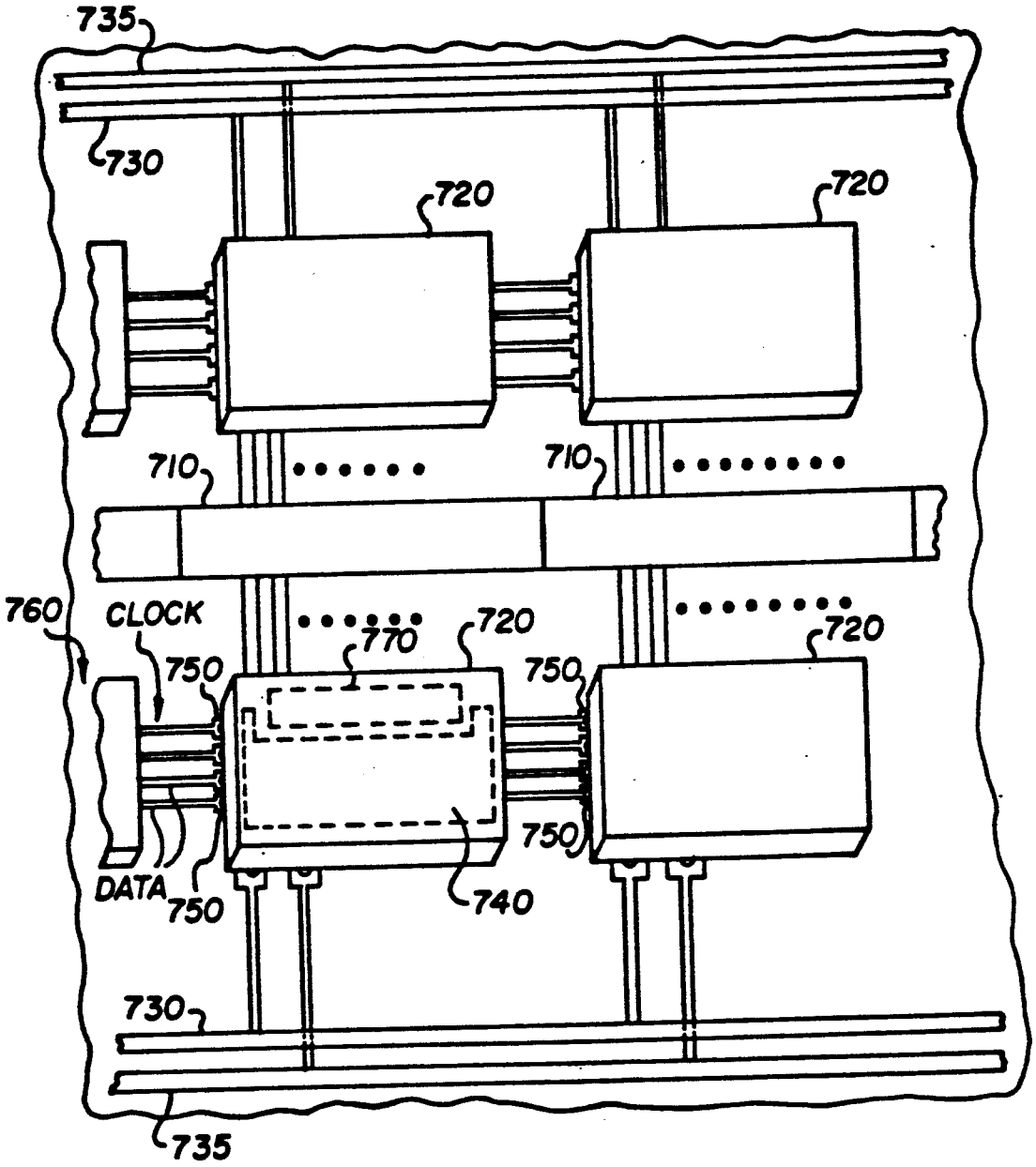
FIG. 7 is a schematic top view of another embodiment of the invention.

Furthermore, although we have described each module as containing a number of LED arrays, a corresponding number of drive circuits and spreader boards all mounted to a common tile, the LED arrays, drive circuits and spreader boards can all be directly mounted to a suitable support plate without the use of specific discrete physical modules or tiles. While eliminating discrete modules complicates the testability of the printhead, it does reduce part count. In this manner, appropriate wiring interconnections between adjacent spreader boards would be connected through any one of a number of specific wiring techniques, such as illustratively wire bonds or tape automated bounding, in order to interconnect a series of such spreader boards in a daisy-chained manner. Moreover, rather than utilize separate spreader boards which are themselves daisy-chained together, as described above, each drive circuit itself could be constructed using well known "flip chip" technology and then appropriately daisy-chained together through an appropriate wiring pattern. Specifically and with reference to FIG. 7, a printhead could consist of a series of co-linearly oriented LED arrays 710 sandwiched between two rows of "flip chip" drive circuits 720 that are, in turn, sandwiched by power conductors or bus bars 730, 735, all mounted on a suitable insulating transparent support member, such as a glass substrate 760. Specifically, such a "flip chip" drive circuit may be an integrated circuit package that includes both an internal multi-layer wiring pattern 740 that heretofore would be situated on a spreader board as well as a number of, e.g. 32, separate drivers. Within that multi-layer pattern, each "flip chip" drive circuit would include a buried signal layer similar to layer 640 shown in FIG. 6 with metallized conductors, such as path 642, extending within this layer between opposing sides of the "flip chip" drive circuit. Other layers internal to the "flip chip" drive circuit would extend connections from the signal layer to the individual drivers as occurs through layer 650 on a spreader board. Appropriate terminations, such as solder bumps 750, would be located near and along opposing edges of, for example, a bottom surface of the "flip chip" drive circuit and would be connected to corresponding opposing ends of appropriate metallized conductors contained within the buried signal layer. The "flip chip" drive circuits would then be mounted in a side to side, though not necessarily abutting orientation, onto the glass substrate that contained a thin film wiring pattern. This thin film wiring pattern would connect each pair of adjacent solder bumps associated with two adjacent "flip chip" drive circuits in order to implement a daisy-chained interconnection therebetween. Separate multi-layered metallized thin film conductors situated on the substrate or discrete bus bar assemblies mounted thereto could be used, in a similar manner as bus bar assembly 215 (or 285), with appropriate metallized connections running therefrom to corresponding solder bumps associated with each drive circuit in order to route power to each successive "flip chip" drive circuit in the printhead. Appropriate solder bumps would also be used to provide connections between each "flip chip" drive circuit and the particular LEDs in a corresponding "flip chip" LED array. The solder bumps associated with the power and LED connections would be oriented along two different opposing edges of each drive circuit, such for example as the horizontal, i.e. top and bottom, edges thereof; while the solder bumps associated with the signal (clock and data) connections would be oriented along the remaining two opposing edges, for example the vertical left and right side edges, of each "flip chip" drive circuit to facilitate making daisy-chained interconnections between any two such adjacent circuits. Here, light emitted from the "flip chip" LED arrays would likely project downward therefrom and through the glass substrate to a suitable lens assembly, such as illustratively a SELFOC lens as described above. Inasmuch as solder bumps provide a removable and replaceable bonding method and the removal of a daisy-chained flip-chip drive circuit breaks the daisy-chained interconnection, use of daisy-chained flip chip drive circuits is likely to permit electrical faults, such as shorted driver, to be readily isolated and therefore facilitate the testability and hence manufacture and subsequent repair of the entire printhead.

Although embodiments of the present invention have been shown and described in detail herein, many other varied embodiments that incorporate the teachings of our invention may be easily constructed by those skilled in the art.

INDUSTRIAL APPLICABILITY AND ADVANTAGES

The present invention is useful in implementing a printhead, and particularly a printhead that contains individual light emitting diodes as the printing elements. The invention advantageously provides apparatus that distributes signals among the individual elements, e.g. the light emitting diodes, that collectively form such a printhead in a manner that is much simpler and significantly more economical than the techniques previously known in the art. Use of this invention in a electronic image printer may advantageously facilitate the evolution of relatively small and inexpensive electronic image printers.

We claim:

1. A printhead comprising:

a support member;

a plurality of modules situated on said support member in a side-to-side relationship in a row;

each of said modules including a tile having mounted thereon a plurality of print element arrays, a corresponding first plurality of drive circuits connected to said print element arrays and a first spreader board, connected to said drive circuits wherein said spreader board has a pre-defined wiring pattern for providing data and clock signals to said drive circuits;

a bus bar affixed to said first spreader board and wherein said first spreader board overhangs an edge of the tile so that a pin extending from the bus bar extends through a through-hole on said first spreader board and does not contact said tile; and plural wire interconnection means existing between each pre-defined area on the wiring pattern on the first spreader board in each first one of said modules and a corresponding pre-defined area in the wiring pattern in the spreader board in each second one of said modules situated adjacent to said first module such that the modules are interconnected in a daisy-chained fashion so that data and clock signals for said drive circuits are passed from one spreader board to another through said daisy-chain connection.

2. The printhead of claim 1 wherein all of the modules are substantially identical, the plurality of print element arrays is mounted to said tile along a transverse axis thereof, the first plurality of drive circuits is situated on a common side of said plurality of print element arrays and are connected to a said print element arrays, and the first spreader board is mounted to said tile outward of said first plurality of drive circuits; and wherein said spreader board contains first and second successions of interconnect pads respectively situated along fist and second opposing side edges of said spreader board and a wiring pattern located therebetween for extending electrical connections among corresponding ones of said first and second successions of interconnect pads and corresponding ones of a third succession of pads situated on said spreader board and electrically connected to said first plurality of drive circuits; and wherein corresponding ones of said interconnect pads located on adjacent spreader boards associated with substantially every pair of contiguous ones of said modules situated on said support member are electrically interconnected through said wired interconnections such that substantially all of said spreader boards in said printhead are interconnected in a daisy-chained fashion.

3. The printhead of claim 2 wherein said bus bar is affixed to the spreader boards in substantially all of said modules so as to route power in parallel thereto.

4. The printhead of claim 3 and wherein the support member has a surface and wherein the plurality of drive circuits, the plurality of print element arrays and the first spreader board are all mounted to a common surface of the tile with the other surface of the tile abutting against the surface of the support member.

5. The printhead of claim 4 wherein the plurality of print element arrays are arranged along a centrally located axis of the tile.

6. The printhead of claim 5 wherein all the print element arrays are identical with each one of the print element arrays having a co-linear array of individual print elements extending across the one array with a substantially equal center-to-center spacing occurring between any pair of said print elements adjacently situated on said one array.

7. The printhead of claim 6, wherein all of said modules are positioned in a successive abutting side-to-side relationship on the support member and are all aligned such that the print elements in said printhead are situated along a common line transversely running across the printhead with an approximately equal center-to-center spacing occurring between each pair of two adjacent ones of said print elements situated along the printhead.

8. The printhead of claim 7, wherein each of said print elements is a light emitting diode.

9. The printhead of claim 3 wherein the wiring pattern is a multi-layer crossover pattern.

10. The printhead of claim 9 wherein the spreader board is formed of a circuit board laminate material containing said wiring pattern.

11. The printhead of claim 3 wherein said tile is metallic and serves as a common connection to one terminal of all the print element arrays mounted thereto and as a common connection to one terminal of all the print elements contained therein.

12. The printhead of claim 11 wherein the tile has a substantially rectangular shape.

13. The printhead of claim 4 wherein said support member comprises a metallic plate.

14. The printhead of claim 4 wherein each of said modules further comprises:

a second plurality of drive circuits mounted to the tile on an opposite side of said print element arrays from that associated with said first plurality of drive circuits, said first and second pluralities of drive circuits being associated with even and odd positioned ones of the print elements situated along the printhead; and a second spreader board substantially identical to the first spreader board and mounted to the tile outward of the second plurality of drive circuits for use in extending electrical connections thereto.

15. The printhead of claim 14 wherein corresponding ones of said interconnect pads located on adjacent ones of said first spreader boards and adjacent ones of said second spreader boards and associated with substantially every pair of contiguous ones of said modules situated on said support member are electrically interconnected such that substantially all of said spreader boards in each half of said printhead are interconnected in a daisy-chained fashion.

16. The printhead of claim 15 wherein said third succession of interconnect pads is situated on each of said spreader boards proximate to and along a third edge thereof which is to be located on said module proximate to either one of said first or second pluralities of drive circuits.

17. The printhead of claim 16 further comprising a separate bus bar assembly affixed to each of said first and second spreader boards so as to separately route power in parallel to each of the spreader boards in both the first and second halves of the printhead.

18. The printhead of claim 17 wherein said bus bar assembly is affixed to each of said spreader boards in either said first or second half of said printhead near and along a fourth edge in said spreader board situated opposite to the third edge thereof.

19. The printhead of claim 18 wherein said bus bar assembly comprises a plurality of individual bus bars, each having a rectangular cross-sectional shape, separated by a dielectric layer situated therebetween.

20. A printhead comprising:

a plurality of print element arrays and a plurality of drive circuits;

means electrically connecting the drive circuits to said print element arrays to provide driving currents to respective print element arrays;

a plurality of signal distribution means for distributing data and clock signals to said drive circuits;

interconnection means interconnecting said distribution means in daisy-chained fashion so that said data and clock signals are passed from one signal distribution means to another through a daisy-chain connection; and wherein the drive circuits are integrated circuit packages which incorporate the distribution means and the interconnection means includes leads for the data and clock signals to daisy-chain said data and clock signals from one drive circuit package to an adjacent drive circuit package.

21. A printhead comprising:

a plurality of print element arrays and a plurality of drive circuits;

means electrically connecting the drive circuits to said print element arrays to provide driving currents to respective print element arrays;

a plurality of signal distribution means for distributing data and clock signals to said drive circuits;

interconnection means interconnecting said distribution means in daisy-chained fashion so that said data and clock signals are passed from one signal distribution means to another through a daisy-chain connection; and wherein the drive circuits are integrated circuit packages each oriented as a flip-chip and which incorporate the distribution means, and the interconnection means includes leads for the data and clock signals to daisy-chain said data and clock signals from one drive circuit package to an adjacent drive circuit package.

22. The printhead of claim 21 and wherein all the data and clock signals are passed from one distribution means to another through said daisy-chain connection.

* * * * *